US008652019B2

(12) United States Patent
Oomoto et al.

(10) Patent No.: US 8,652,019 B2
(45) Date of Patent: Feb. 18, 2014

(54) FIXING MEMBER AND METHOD FOR MANUFACTURING SAME

(75) Inventors: Noboru Oomoto, Toyokawa (JP); Shoichi Yoshikawa, Okazaki (JP); Shigeru Tashiro, Toyokawa (JP); Atsuhiko Shimoyama, Tahara (JP); Yoshiyuki Toso, Toyokawa (JP); Tou Matsunaga, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 459 days.

(21) Appl. No.: 13/023,618

(22) Filed: Feb. 9, 2011

(65) Prior Publication Data

US 2011/0200371 A1 Aug. 18, 2011

(30) Foreign Application Priority Data

Feb. 16, 2010 (JP) ..... 2010-031386

(51) Int. Cl.
*G03G 15/20* (2006.01)

(52) U.S. Cl.
USPC ..... 492/18; 492/46; 492/56; 399/333

(58) Field of Classification Search
USPC ..... 492/18, 39, 46, 56; 399/330, 331, 333
See application file for complete search history.

(56) References Cited

U.S. PATENT DOCUMENTS 4,098,631 A * 7/1978 Stryjewski ..... 156/221
4,883,715 A 11/1989 Kuge et al.
4,977,308 A * 12/1990 Soga ..... 219/469
(Continued)

FOREIGN PATENT DOCUMENTS

CN 1996165 A 7/2007
EP 0 269 262 A2 6/1988
(Continued)

OTHER PUBLICATIONS

The First Office Action issued on May 2, 2013, by the Chinese Patent Office in corresponding Chinese Patent Application No. 201110038763.1, and an English Translation of the Office Action. (15 pages).

(Continued)

*Primary Examiner* — David Bryant
*Assistant Examiner* — Jason L Vaughan
(74) *Attorney, Agent, or Firm* — Buchanan Ingersoll & Rooney PC

(57) ABSTRACT

A fixing member according to the present invention is such one as is brought into pressure contact with a conveyed sheet to fix an image onto the sheet. The fixing member comprises a cylindrical or annular base material, a rubber layer provided so as to cover an outer surface of the base material and having elasticity, and an outer layer provided so as to cover an outer surface of the rubber layer for aiding release of the sheet. A siloxane content in a central section of the rubber layer is less than twice the siloxane content in an end portion of the rubber layer with respect to a width direction vertical to a circumferential direction on the base material.

12 Claims, 6 Drawing Sheets

(56) References Cited

U.S. PATENT DOCUMENTS

| | | | | | |
|---|---|---|---|---|---|
| 5,327,202 | A | * | 7/1994 | Nami et al. | 399/333 |
| 5,390,006 | A | | 2/1995 | Wakabayashi et al. | |
| 5,582,885 | A | * | 12/1996 | Nakamura et al. | 428/35.8 |
| 6,231,954 | B1 | | 5/2001 | Yoshida et al. | |
| 7,087,305 | B2 | * | 8/2006 | Chen et al. | 428/421 |
| 7,211,362 | B2 | * | 5/2007 | Chen et al | 430/124.23 |
| 7,459,203 | B2 | * | 12/2008 | Pickering | 428/212 |
| 7,682,542 | B2 | * | 3/2010 | Chen et al. | 264/235 |
| 7,725,068 | B2 | * | 5/2010 | Matsunaka et al. | 399/333 |
| 7,955,690 | B2 | * | 6/2011 | Pickering et al. | 428/212 |
| 7,991,341 | B2 | * | 8/2011 | Matsunaka et al. | 399/333 |
| 8,007,912 | B2 | * | 8/2011 | Kuntz et al. | 428/421 |
| 8,263,702 | B2 | * | 9/2012 | Zhang et al. | 524/537 |
| 8,301,068 | B2 | * | 10/2012 | Kondoh et al. | 399/333 |
| 2007/0135555 | A1 | | 6/2007 | Hirabayashi et al. | |

FOREIGN PATENT DOCUMENTS

| | | | | | |
|---|---|---|---|---|---|
| EP | 1 882 993 | A1 | | 1/2008 | |
| JP | 5-150605 | A | | 6/1993 | |
| JP | 06051664 | A | * | 2/1994 | G03G 15/20 |
| JP | 2001-290387 | A | | 10/2001 | |
| JP | 2008-163282 | A | | 7/2008 | |
| JP | 2009-006586 | A | | 1/2009 | |

OTHER PUBLICATIONS

Office Action (Preliminary Notice of Rejection) dated Nov. 22, 2011, issued in the corresponding Japanese Patent Application No. 2010-031386, and an English Translation thereof. (9 pages).

Search Reporting dated Dec. 28, 2011, issued in the corresponding European Patent Application No. 11153979.7. (8 pages).

* cited by examiner

FIXING MEMBER AND METHOD FOR MANUFACTURING SAME

This application is based on an application No. 2010-031386 filed in Japan on Feb. 16, 2010, the entire content of which is hereby incorporated by reference.

BACKGROUND ART

The present invention relates to a fixing member and a method for manufacturing the same, and more specifically relates to a fixing member which constitutes an electrophotographic image forming apparatus such as printers, copying machines and facsimile machines and to a method for manufacturing the same.

It is known for this kind of an electrophotographic image forming apparatus that several kinds of chemical substances are emitted during imaging operation. Typical chemical substances to be emitted (chemical emission) include ozone generated during charging of a photoconductor and toner powder dust generated during developing or fixing operation. Conventional solutions to the chemical emission include taking measures against the emission source of such chemical emission so as to decline the emission amount itself, and providing a filter to prevent emitted substances from being discharged outside from the apparatus. For example, in JP H5-150605 A, a divider plate is provided inside the apparatus to guide generated ozone to an ozonolysis device.

However, with a recent increase in awareness of global environmental conservation, ultra fine particles (with a particle size of 100 nm or less), which are substances different from ozone or toner powder dust, generated from electrophotographic image forming apparatuses have come to be seen as a problem. It has been unknown hitherto where such ultra fine particles are generated inside an image forming apparatus, and therefore it has been impossible to take effective measures for the problem. As a result, the ultra fine particles are considered to have caused contamination of the environment inside or around the apparatus.

As a result of the investigation conducted by the inventor of the present invention, it was found out that in an electrophotographic image forming apparatus, such ultra fine particles are mainly generated in a fixing device, more specifically in a rubber layer included in a fixing member (such as rollers and belts) which forms a nip section for fixing operation.

As shown in FIG. 7A, a general fixing member 300 includes three layers composed of a base material 301 made of a cylindrical core metal or an annular endless belt, a rubber layer 302 provided so as to cover the outer surface of the base material 301, and an outer layer 303 provided so as to cover the outer surface of the rubber layer 302. In this example, a heater 305 is provided in an internal space of the base material 301 for heating the fixing member 300 to a specified target temperature (a fixing temperature in the range of 180° C. to 200° C.). The rubber layer 302, which is made of a silicone rubber material, has heat tolerance to the fixing temperature and elasticity for allowing for the length of a nip section. The outer layer 303 is made of, for example, PFAs (tetrafluoro ethylene perfluoroalkyl vinyl ether copolymers) for aiding release of a sheet (recording material such as paper sheets) which passed the nip section. An end portion 302*e* of the rubber layer 302 and an end portion 303*e* of the outer layer 303 are both positioned inner than an end portion 301*e* of the base material 301 with respect to a direction along a central axis C of the base material 301.

As a result of investigation conducted by the inventor of the present invention, it has been found out that as shown in FIG. 7B, when the base material 301, the rubber layer 302 and the like were heated with the heater 305 (reference sign H shows heat rays), siloxanes (designated by reference sign G) were generated in the form of ultra fine particles from the silicone rubber material which constitutes the rubber layer 302. Since the outer layer 303 made of PFAs and the like typically has a nature hard to transmit the ultra fine particles (gas barrier property), siloxanes G are emitted from the end portion 302*e* of the rubber layer 302. The emitted siloxanes G pollute the environment inside and around the image forming apparatus.

Examples of siloxanes include hexamethyldisiloxane (abbreviation: L2, molecular formula: $C_6H_{18}O_1Si_2$), hexamethylcyclotrisiloxane (abbreviation: D3, molecular formula: $C_6H_{18}O_3Si_3$), octamethyltrisiloxane (abbreviation: L3, molecular formula: $C_8H_{24}O_2Si_3$), octamethylcyclotetrasiloxane (abbreviation: D4, molecular formula: $C_8H_{24}O_4Si_4$), decamethyltetrasiloxane (abbreviation: L4, molecular formula: $C_{10}H_{30}O_3Si_4$), decamethylcyclopentasiloxane (abbreviation: D5, molecular formula: $C_{10}H_{30}O_5Si_5$), dodecamethylpentasiloxane (abbreviation: L5, molecular formula: $C_{22}H_{36}O_4Si_5$), and dodecamethylcyclohexasiloxane (abbreviation: D6, molecular formula: $C_{12}H_{36}O_6Si_6$).

In conventional manufacturing process for this kind of fixing member 300, as shown in Step S101 in FIG. 3A, an outer layer 303 made of PFA is first placed over an outer surface of a base material 301 made of a core metal, and then silicone rubber is injected into a clearance between the base material 301 and the outer layer 303 by injection molding (the injection molding is equivalent to primary vulcanization) to provide three-layer structure composed of the base material 301, the rubber layer 302 and the outer layer 303. Then, as shown in Step A102, secondary vulcanization is performed to provide the rubber layer 302 with elasticity and strength and to bring the outer layer 303 made of PFA into tight contact with the rubber layer 302.

Thus, secondary vulcanization is conventionally performed in the state where the rubber layer 302 is covered with the outer layer 303 made of PFA, and as a result, the amount of siloxane G remaining in a central section of the rubber layer 302 is considered to be several times larger than that in an end portion of the rubber layer 302.

SUMMARY OF THE INVENTION

A fixing member which is brought into pressure contact with a conveyed sheet to fix an image onto the sheet, according to the present invention, comprises:

a cylindrical or annular base material; a rubber layer provided so as to cover an outer surface of the base material and having elasticity; and an outer layer provided so as to cover an outer surface of the rubber layer for aiding release of the sheet, wherein a siloxane content in a central section of the rubber layer is less than twice the siloxane content in an end portion of the rubber layer with respect to a width direction vertical to a circumferential direction on the base material.

A fixing device according to the present invention, comprising:

a fixing member which is brought into pressure contact with a conveyed sheet to fix an image onto the sheet; and a heating source for heating the fixing member to a target temperature for fixing operation, wherein the fixing member comprises:

a cylindrical or annular base material; a rubber layer provided so as to cover an outer surface of the base material and having elasticity; and an outer layer provided so as to cover an outer surface of the rubber layer for aiding release of the sheet, wherein a siloxane content in a central section of the rubber layer is less than twice the siloxane content in an end portion of the rubber layer with respect to a width direction vertical to a circumferential direction on the base material.

A method for manufacturing a fixing member which is brought into pressure contact with a conveyed sheet to fix an image onto the sheet, according to the present invention, comprises steps of:

forming a rubber layer on an outer surface of a cylindrical or annular base material by injection molding as primary vulcanization;

performing secondary vulcanization of the rubber layer to provide the rubber layer with elasticity; and then providing an outer layer to the outer surface of the rubber layer for aiding release of the sheet.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Figure 1:
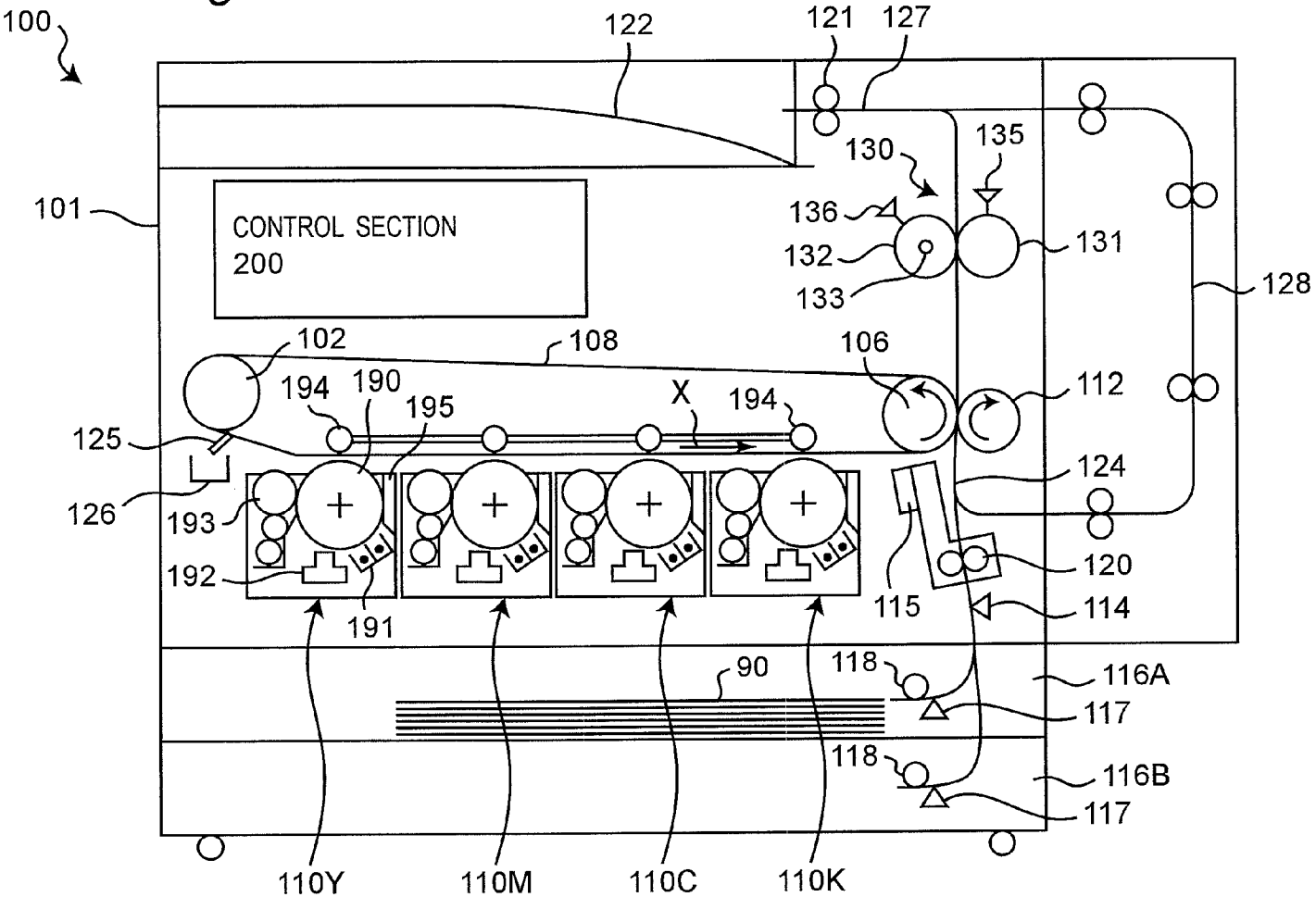
FIG. 1 is a view showing an overall configuration of an image forming apparatus having a fixing roller as one embodiment of the invention.

FIG. 1 shows a schematic configuration of a color tandem-type image forming apparatus 100 having a fixing roller in one embodiment of the invention. The image forming apparatus, which is a multi-functional machine having functions of a scanner, a copier, a printer and other apparatuses, is called MFT (Multi Function Peripheral)

The image forming apparatus 100 includes an intermediate transfer belt 108 as an annular intermediate transfer body provided generally in the center inside a main body casing 101, the intermediate transfer belt 108 being wound around two rollers 102, 106 and moving in the circumferential direction. One roller 102 out of two rollers 102 and 106 is placed on the left-hand side in the drawing, while the other roller 106 is placed on the right-hand side in the drawing. The intermediate transfer belt 108 is supported on these rollers 102, 106, and is rotated in an arrow X direction.

Imaging units 110Y, 110M, 110C and 110K as printing sections corresponding to respective color toners of yellow (Y), magenta (M), cyan (C) and black (K) are placed below the intermediate transfer belt 108 side by side in order from the left-hand side in the drawing.

The respective imaging units 110Y, 110M, 110C and 110K have completely similar configuration except for a difference in toner color that the respective units handle. More specifically, the yellow imaging unit 110Y for example is integrally composed of a photoconductor drum 190, a charging device 191, an exposure device 192, a developing device 193 for development with use of toner, and a cleaning device 195. A primary transfer roller 194 is provided in a position facing the photoconductor drum 190 across the intermediate transfer belt 108. At the time of image formation, the surface of the photoconductor drum 190 is first uniformly charged by the charging device 191, and then the surface of the photoconductor drum 190 is exposed by the exposure device 192 in response to an image signal inputted from an unshown external unit to form a latent image thereon. Next, the latent image on the surface of the photoconductor drum 190 is developed into a toner image by the developing device 193. This toner image is transferred onto the intermediate transfer belt 108 upon voltage application to between the photoconductor drum 190 and the primary transfer roller 194. The transfer residual toner on the surface of the photoconductor drum 190 is cleaned by the cleaning device 195.

As the intermediate transfer belt 108 moves in the arrow X direction, overlapped toner images of four colors are formed as inputted images on the intermediate transfer belt 108 by each of the imaging units 110Y, 110M, 110C and 110K.

Provided on the left-hand side of the intermediate transfer belt 108 are a cleaning device 125 for removing residual toner from the surface of the intermediate transfer belt 108 and a toner collecting box 126 for collecting the toner removed by the cleaning device 125. A secondary transfer roller 112 as a secondary transfer member is provided on the right-hand side of the intermediate transfer belt 108 across a conveying path 124 for paper sheets. A conveying roller 120 is provided at a position corresponding to the upstream side of the secondary transfer roller 112 on the conveying path 124. An optical concentration sensor 115 is provided as a toner concentration sensor for detecting toner patterns on the intermediate transfer belt 108.

A fixing device 130 is provided in the upper right part inside the main body casing 101 as a fixing section for fixing toner onto paper sheets. The fixing device 130 includes a heating roller 132 as a fixing member extending perpendicularly to the page of FIG. 1 and a pressure roller 131 as a pressure member. The heating roller 132 is heated to a specified target temperature (a fixing temperature in the range of 180° C. to 200° C. in this example) with a heater 133 as a heating source. The pressure roller 131 is biased toward the heating roller 132 with an unshown spring. Accordingly, the pressure roller 131 and the heating roller 132 form a nip section for fixation. As a paper sheet 90 carrying a toner image transferred thereon passes through the nip section, the toner image is fixed onto the paper sheet 90. The temperature of the pressure roller 131 and the heating roller 132 is detected by temperature sensors 135, 136 which are each constituted of thermistors in this example.

Paper cassettes 116A, 116B as paper feed ports for storing paper sheets 90 as printing media, on which output images should be formed, are provided in two levels in the lower part of the main body casing 101. The paper cassettes 116A, 116B are each equipped with a feed roller 118 for sending out paper sheets and a feeding sensor 117 for sensing the sent-out paper sheets. For easier understanding, the drawing shows the state in which the paper sheets 90 are stored only in the paper cassette 116A.

A control section 200 constituted of a CPU (Central Processing Unit) is provided in the main body casing 101 for controlling operation of the entire image forming apparatus.

At the time of image formation, paper sheets 90 are sent out one-by-one by the feed roller 118 from, for example, the paper cassette 116A to the conveying path 124 under control by the control section 200. The paper sheets 90 sent out to the conveying path 124 are sent into a toner transfer position between the intermediate transfer belt 108 and the secondary transfer roller 112 by the conveying roller 120 with the timing decided by a resist sensor 114. Meanwhile, an overlapped toner image of four colors is formed on the intermediate transfer belt 108 by each of the imaging units 110Y, 110M, 110C and 110K as mentioned before. The toner image of four colors on the intermediate transfer belt 108 is transferred onto a paper sheet 90, which was sent into the above-mentioned toner transfer position, by the secondary transfer roller 112. The paper sheet 90 with the toner image transferred thereon receives heat and pressure while being conveyed through the nip section formed between the pressure roller 131 and the heating roller 132 of the fixing device 130. As a result, the toner image is fixed onto the paper sheet 90. The paper sheet 90 with the toner image fixed thereto is then discharged by a paper ejecting roller 121 into a paper ejection tray section 122 provided on the upper surface of the main body casing 101 through a paper ejecting path 127. In this example, a switch-back conveying path 128 is provided for resending paper sheets 90 into the toner transfer position in the case of double-side printing.

Figure 2B:
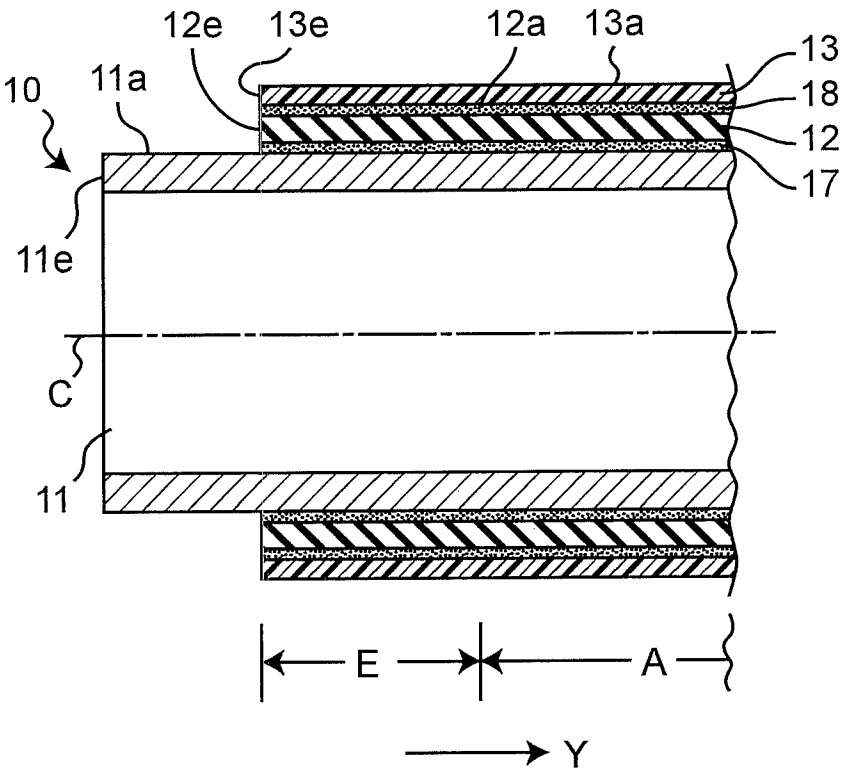
FIG. 2B is a view showing a sectional configuration of the fixing roller taken along the central axis.
Figure 2A:
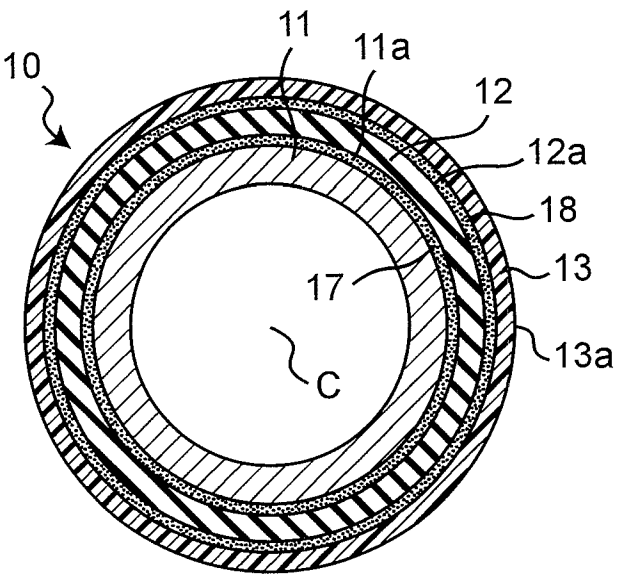
FIG. 2A is a view showing a sectional configuration of the fixing roller taken vertically to a central axis.

FIGS. 2A and 2B show a cross sectional configuration of one aspect (denoted by reference sign 10) of a fixing roller 132 as a fixing member included in the image forming apparatus 100. More specifically, FIG. 2A shows a sectional configuration of the fixing roller 10 taken vertically to a central axis C, and FIG. 2B shows a sectional configuration of the fixing roller 10 taken along the central axis C.

The fixing roller 10 is composed of three layers including a core metal 11 as a cylindrical base material, a rubber layer 12 provided so as to cover an outer surface 11*a* of the core metal 11 via an adhesive 17, and an outer layer 13 provided so as to cover an outer surface 12*a* of the rubber layer 12 via an adhesive 18. A heater (equivalent to the heater 133 in FIG. 1) is provided in the internal space of the core metal 11 as a heating source for heating the fixing roller 10 to a specified target temperature (a fixing temperature in the range of 180° C. to 200° C. in this example).

The core metal 11 is made of a metallic material such as aluminum and iron. While the thickness of the core metal 11 is about 0.1 mm to 5 mm in this example, the thickness should preferably be about 0.1 mm to 1.5 mm in consideration of weight saving and warm-up time. The external diameter of the core metal 11 is set at about 10 mm to 50 mm in this example.

The rubber layer 12, which is made of a silicone rubber material, has heat tolerance to the fixing temperature and elasticity for allowing for the size of a region with which the paper sheet 90 is brought into pressure contact (length of the nip section). The thickness of the rubber layer 12, which should preferably be in the range of 0.05 mm to 2 mm, is about 0.2 mm to 0.4 mm in this example.

The outer layer 13, which is made of a fluorine-based resin such as PFA (tetrafluoroethylene perfluoro alkyl vinyl ether copolymer), PTFE (polytetrafluoroethylene) and ETFE (ethylene tetrafluoroethylene), has heat tolerance to the fixing temperature, releasability to aid release of the paper sheets 90 which passed the nip section, and a nature hard to transmit the ultra fine particles generated from the rubber layer 12 (gas barrier property). The thickness of the outer layer 13, which should preferably be in the range of 5 μm to 100 μm, is set at about 30 μm to 40 μm in this example.

An end portion 12*e* of the rubber layer 12 and an end portion 13*e* of the outer layer 13 are both placed in the same position inside an end portion 11*e* of the core metal 11 with respect to a direction Y along the central axis C of the core metal 11, i.e., with respect to a width direction Y of a paper sheet 90 which should be brought into pressure contact with the fixing roller 10.

In the image forming apparatus having the fixing roller 10, the fixing roller 10 is heated by a heater 133 to a fixing temperature in the range of 180° C. to 200° C. A conveyed paper sheet 90 is brought into pressure contact with the outer surface 13*a* of the fixing roller 10 to fix an image on the paper sheet 90.

Figure 3A:
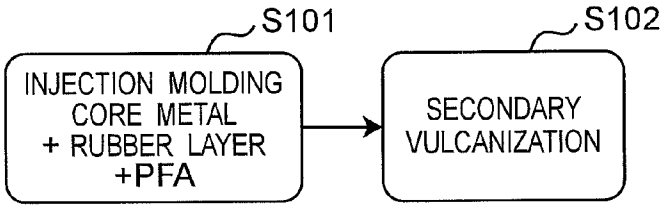
FIG. 3A is a view showing a conventional flow for manufacturing a fixing roller.
Figure 3B:
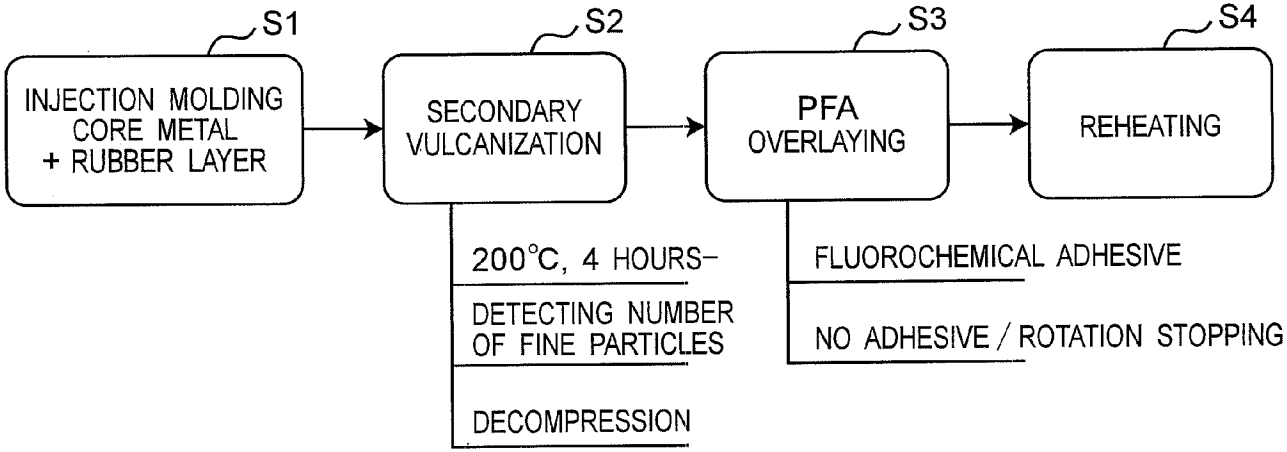
FIG. 3B is a view showing a flow of a method for manufacturing a fixing roller as one embodiment of the invention.

The fixing roller 10 is manufactured according to the flow of a manufacturing method shown in FIG. 3B.

i) In Step S1 in FIG. 3B, a primer (an inexpensive silicone-type adhesive such as XP81-405 (Momentive Performance Materials Japan LLC) in this example) 17 used as an adhesive is first applied to the outer surface of the cylindrical core metal 11, and a rubber layer 12 is formed thereon by injection molding (the injection molding is equivalent to primary vulcanization).

ii) Next in Step S2, secondary vulcanization of the rubber layer 12 is performed to provide the rubber layer 12 with elasticity so as to allow for the size of a region with which a paper sheet 90 is brought into pressure contact.

Figure 3C:
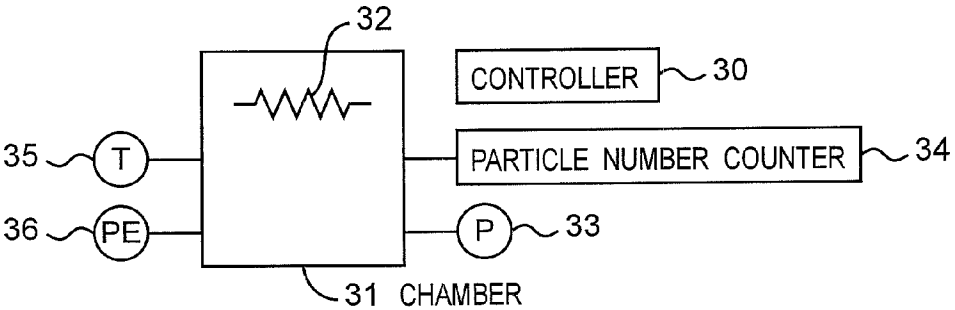
FIG. 3C is a view showing a configuration of a device which performs secondary vulcanization in the flow of the manufacturing method.

The secondary vulcanization is performed in the state where the core metal 11 with the rubber layer 12 formed thereon is housed in a chamber 31 of a vulcanizer shown in FIG. 3C. A heater 32 is built in the chamber 31, so that the heater 32 can heat the inside of the chamber 31 to increase the temperature thereof. The temperature inside the chamber 31 is observed with a temperature sensor 35. The chamber 31 is connected to a vacuum pump 33 as an exhaust device, which can exhaust air from the chamber 31 for pressure reduction. The pressure (ambient pressure) inside the chamber 31 is observed with a pressure sensor 36. Further in this example, the chamber 31 has a commercially available particle number counter (e.g., Ultra Fine Particle Monitor (UFP)/3031 made by Tokyo Dylec Corp.) 34 provided for observing the number of fine particles inside the chamber. The particle number counter 34 counts the number of fine particles inside the chamber. The temperature inside the chamber observed with the temperature sensor 35, the pressure inside the chamber observed with the pressure sensor 36, and the number of fine particles inside the chamber observed with the particle number counter 34 are each inputted into a controller 30.

The controller 30 controls the entire vulcanizer. More specifically, the controller 30 controls the heater 32 based on an output of the temperature sensor 35 so that the temperature inside the chamber 31 reaches a target vulcanizing temperature (200° C. or higher in this example). The controller 30 also controls the vacuum pump 33 based on an output of the pressure sensor 36 so that the pressure inside the chamber 31 reaches a target pressure (atmospheric pressure or lower in this example). Further, the controller 30 incorporates an unshown timer to exercise control so that the processing time inside the chamber coincides with specified time (4 hours or longer in this example).

In one example, as with the secondary vulcanization conditions of general rubber products, the secondary vulcanization is performed under the set conditions of a temperature to be 200° C., a pressure to be atmospheric pressure, and a processing time to be 4 hours.

iii) Then in Step S3 in FIG. 3B, a primer (a fluorochemical adhesive such as GLP-103SR (Daikin Industries, LTD.) in this example) 18 used as an adhesive is applied to the outer surface 12*a* of the rubber layer 12 which was subjected to secondary vulcanization, and the outer layer 13 made of PFA for example is overlaid thereon.

In this case, since the fluorochemical adhesive 18 is siloxane-free, it becomes possible to desirably prevent the fluorochemical adhesive 18 from becoming an emission source of siloxane.

iv) At last in Step S4, the outer layer 13 is reheated so as to cause heat contraction of the outer layer 13 which is made of PFA and to bring the outer layer 13 into tight contact with the rubber layer 12 via the adhesive 18.

Thus, the fixing roller 10 is manufactured.

In the method for manufacturing the fixing roller 10, secondary vulcanization of the rubber layer 12 is performed before the Step S3 which provides the outer layer 13 to the outer surface 12*a* of the rubber layer 12, in other words, in the state where the outer surface 12*a* of the rubber layer 12 is exposed. Therefore, in the step (Step S2) of the secondary vulcanization, siloxane as ultra fine particles is emitted from the entire region of the outer surface 12*a* of the rubber layer 12, which effectively reduces residual siloxane in the entire region of the rubber layer 12. As a result, in the manufactured fixing member, generation of ultra fine particles from the rubber layer 12 is suppressed. Therefore, it becomes possible to prevent siloxane from causing contamination of the environment inside and around an image forming apparatus.

Moreover, if the secondary vulcanization is performed under the conditions of a temperature being 200° C. or higher, a pressure being atmospheric pressure or lower, and a time being 4 hours or longer, siloxane as ultra fine particles is emitted easily from the entire region of the outer surface 12*a* of the rubber layer 12 and ends up being exhausted. As a result, the residual siloxane in the entire region of the rubber layer 12 is desirably reduced more effectively.

The conditions of the secondary vulcanization are such that when processing is conducted while the number of fine particles in the chamber 31 is observed with the particle number counter 34, siloxane as ultra fine particles emitted from the rubber layer 12 is exhausted and the number of fine particles in the chamber 31 becomes 2000 per cubic centimeter (i.e., 2000/cc). In other words, it is preferable to feed back observation results by the particle number counter 34 to the controller 30 and set the conditions of secondary vulcanization (temperature, pressure, time) so that the number of fine particles in the chamber becomes the value (2000/cc) or less. Accordingly, the quality of the manufactured fixing roller 10 can be stabilized.

Figure 4:
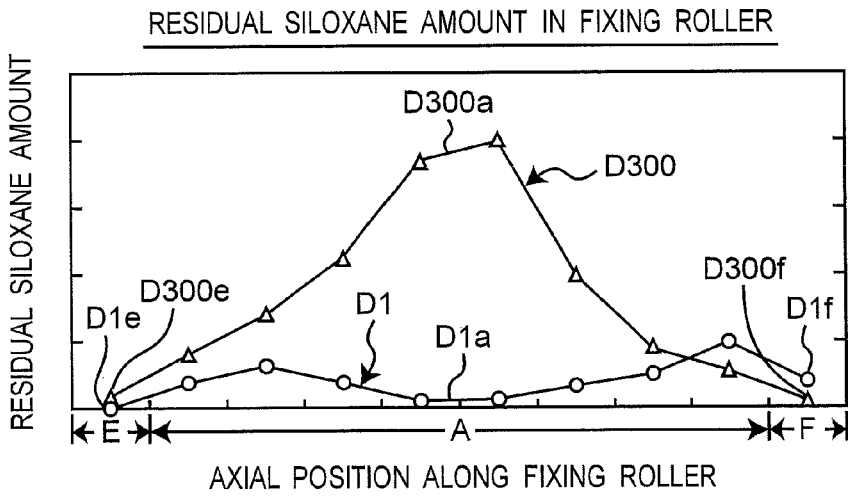
FIG. 4 is a view showing an amount of residual siloxane in a rubber layer of a fixing roller manufactured by the manufacturing method of FIG. 3B in relation to an axial position of the fixing roller.

FIG. 4 shows data D1 on the amount of residual siloxane about the rubber layer 12 of the fixing roller 10 manufactured by the above-mentioned manufacturing method, i.e., data on the amount of residual siloxane measured in every position (axial position) in a direction Y along the central axis C of the fixing roller 10. The horizontal axis (axial position) in FIG. 4 is set to divide an area of the fixing roller 10 which includes the rubber layer 12 into ten sections in the direction Y along the central axis C (a section E including the end portion 12*e* of the rubber layer 12 is shown in FIG. 2B for reference). The vertical axis in FIG. 4 expresses a siloxane content (the amount of residual siloxane) in the rubber layer 12 in an arbitrary unit. The amount of residual siloxane in the rubber layer 12 was obtained by analyzing a solution, which was obtained by adjusting a molded rubber sample by solvent extraction, with use of a gas chromatograph and by quantifying low-molecular siloxane. For comparison, data D300 about a rubber layer 302 of a fixing roller 300 manufactured by a manufacturing method in a conventional example is also shown in FIG. 4.

As shown in FIG. 4, in the fixing roller 300 manufactured by the manufacturing method in the conventional example, the residual siloxane amounts D300*e* and D300*f* in the rubber layer in sections E and F in end portions with respect to the axial direction are small, whereas in an inner section A, the residual siloxane amount D300*a* in the rubber layer is large (the amount in the central section is several times larger than those in the end portions). In contrast, in the fixing roller 10 manufactured by the above-mentioned manufacturing method, the residual siloxane amounts D10*e*, D10*f* and D10*a* in the rubber layer in the sections E and F in the end portions and in the inner section A with respect to the axial direction are all small and generally constant.

Thus, in the fixing roller 10 manufactured by the above-mentioned manufacturing method, the residual siloxane in the entire region of the rubber layer 12 could effectively be reduced. In actuality, in the fixing roller 10 manufactured by the above-mentioned manufacturing method, the siloxane content in the central section of the rubber layer 12 is substantially equal to the siloxane content in the end portion of the rubber layer 12, and it can be said, therefore, that the siloxane content in the central section of the rubber layer 12 is less than twice the siloxane content in the end portion of the rubber layer 12 even with consideration for variations.

Figure 5:
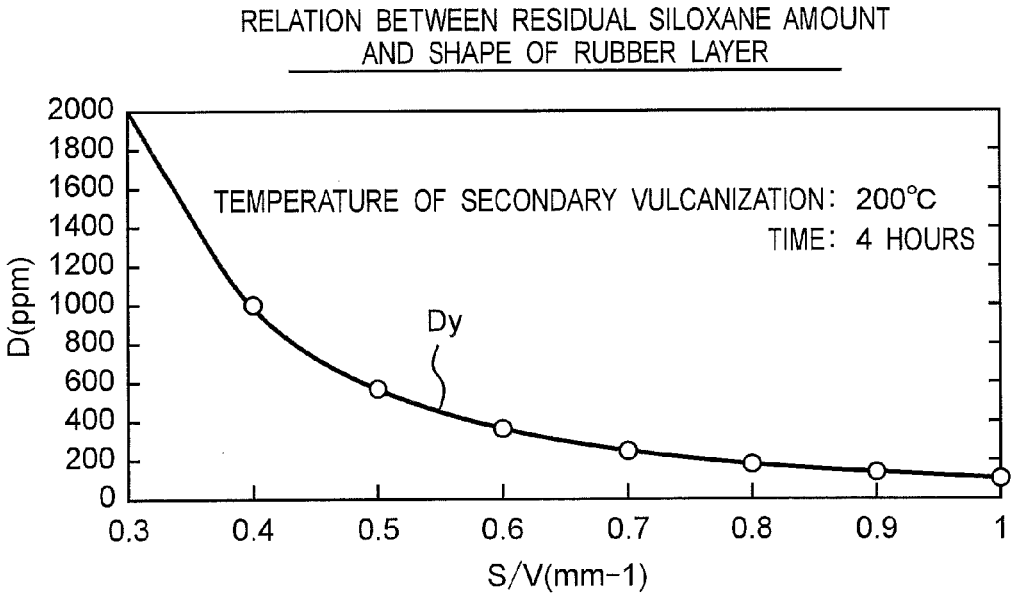
FIG. 5 is a view showing the relation between the amount of residual siloxane in the rubber layer of the fixing roller and a shape factor of the rubber layer.

FIG. 5 shows a relation between an amount of residual siloxane in the rubber layer 12 of the fixing roller and a shape factor of the rubber layer 12. The vertical axis in FIG. 5 expresses the siloxane content (the amount of residual siloxane) in the rubber layer 12. The horizontal axis in FIG. 5 expresses a shape factor S/V ($mm^{-1}$), where S represents the surface area of the rubber layer 12, and V represents the volume of the rubber layer 12 (volume per unit length with respect to direction Y along the central axis C of the fixing roller 10). That is, $S=2\pi\times b$ and $V=\pi\times(b^2-a^2)$ can be expressed, where represents an internal diameter of the rubber layer 12 in the unit of millimeter (mm) and "b" represents an external diameter of the rubber layer 12 in the unit of millimeter (mm).

Under the conditions of the above-mentioned secondary vulcanization (a temperature being 200° C., a pressure being atmospheric pressure and a processing time being 4 hours), with a technique of curve fitting to an experimental result (fitting of curve Dy to measurement data expressed with symbol "○" in FIG. 5), it was found out that the following relation is satisfied:

$$D = 100 \times (S/V)^{-2.5}$$

$$= 100 \times ((2 \times b)/(b^2 - a^2))^{-2.5}$$

where D represents a siloxane content (in the central section for example) of the rubber layer 12 in the unit of parts per million (ppm). In short, even when variation is taken into consideration and regarded as twice the observed amount, it can be said that the following relational expression is satisfied:

$$D < 100 \times ((2 \times b)/(b^2 - a^2))^{-2.5} \times 2$$

This result indicates that qualitatively, the amount D of residual siloxane decreases with larger surface area S and smaller volume V.

Figure 6B:
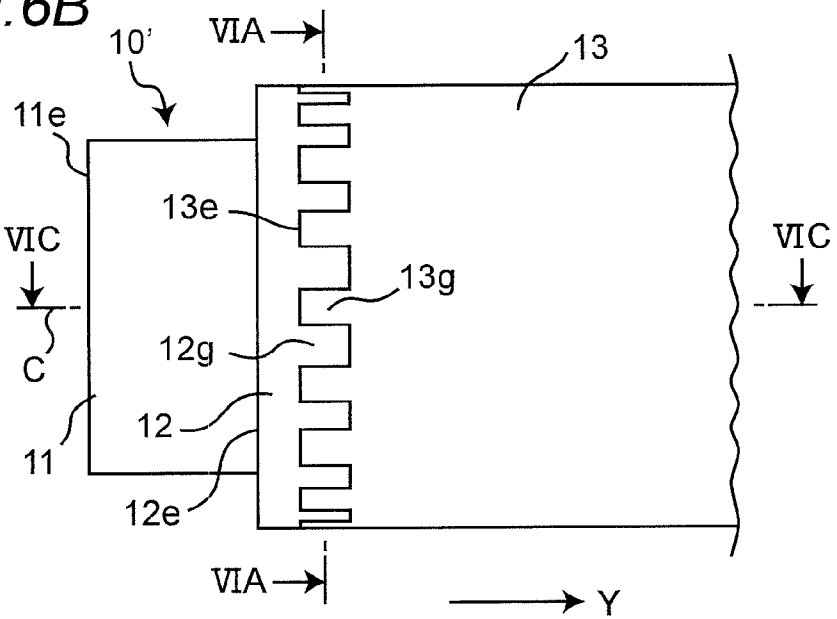
FIG. 6B is a view showing the fixing roller viewed from a direction vertical to the central axis.
Figure 6C:
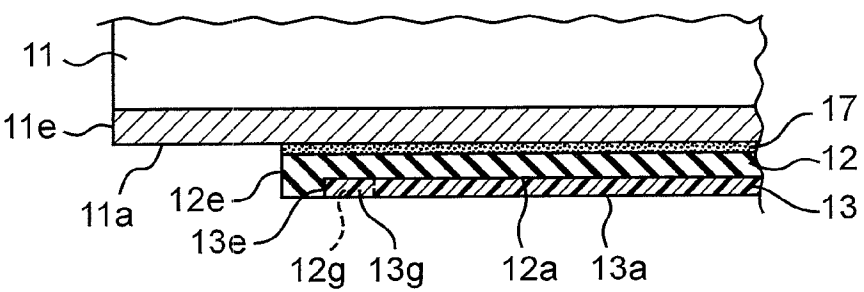
FIG. 6C is a view showing a sectional configuration of a part of the fixing roller taken along the central axis, which is equivalent to a cross section along VIC-VIC line in FIG. 6B.
Figure 6A:
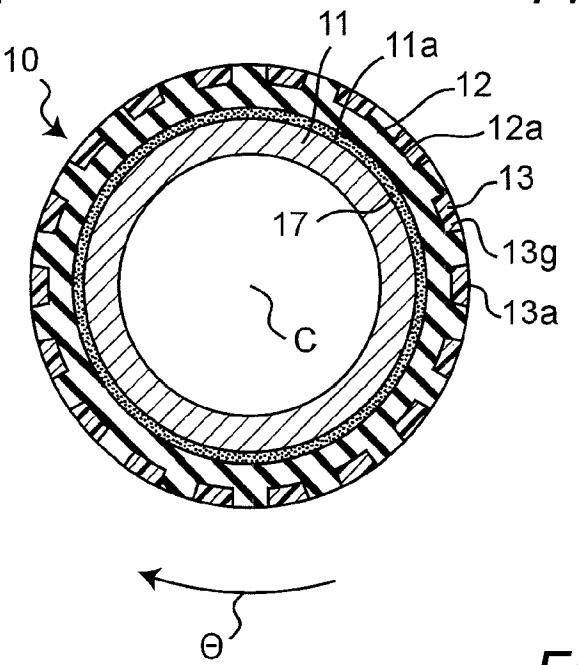
FIG. 6A is a view showing a sectional configuration of a fixing roller in a modified example taken vertically to a central axis, which is equivalent to a cross section along VIA-VIA line in the following FIG. 6B.
Figure 7B:
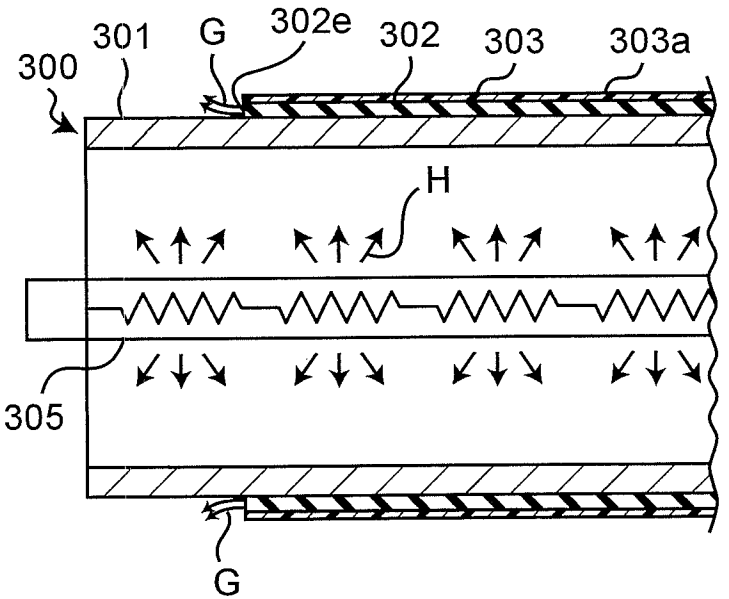
Fig.7B RELATED ART
FIG. 7B is a view showing the state of siloxane as ultra fine particles being emitted from an end portion of a rubber layer in a fixing roller.
Figure 7A:
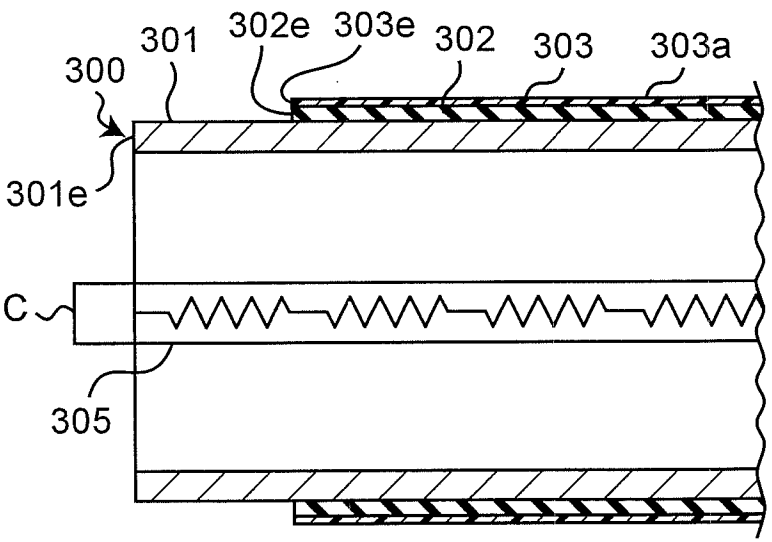
Fig.7A RELATED ART
FIG. 7A is a cross sectional view showing a general configuration of a fixing roller.

FIG. 6A, FIG. 6B, and FIG. 6C show a fixing roller (denoted by reference sign 10') in a modified example, which is a modification of the aforementioned fixing roller 10. FIG. 6B is a view showing the fixing roller 10' viewed from the direction vertical to a central axis C. FIG. 6A shows a sectional configuration of the fixing roller 10' taken vertically to the central axis C along VIA-VIA line in FIG. 6B. FIG. 6C shows a sectional configuration of a part of the fixing roller 10' (a portion on the near side shown in FIG. 6B) taken along VIC-VIC line. In FIG. 6A, FIG. 6B, and FIG. 6C, component members identical to those in FIG. 2A and FIG. 2B are denoted by identical reference signs to omit individual explanation.

Unlike the example in FIG. 2A and FIG. 2B, in this fixing roller 10', an end portion 12*e* of a rubber layer 12 is located closer to an end portion 11*e* of a core metal 11 than an end portion 13*e* of an outer layer 13 with respect to a direction along the central axis C of the core metal 11, i.e., with respect to a width direction of the paper sheet 90 which should be brought into pressure contact with the fixing roller 11. The fixing roller 10' also has a rotation stopping section for stopping the outer layer 13 from rotating (spinning free) relative to the rubber layer 12 in a circumferential direction θ (shown in FIG. 6A). More specifically, as clearly shown in FIG. 6B, a portion in the vicinity of the end portion 13*e* of the outer layer 13 is formed toothedly with respect to an axial direction Y including a portion 13*g* projecting in a direction −Y. Meanwhile, a portion in the vicinity of the end portion 12*e* of the rubber layer 12 is formed toothedly with respect to the axial direction Y including a portion 12*g* projecting in a direction +Y. The portion 12*g* protrudes to the height level of the outer surface 13*a* of the outer layer 13 as is clear from FIG. 6C. The projecting portion 12*g* in the vicinity of the end portion 12*e* of the rubber layer 12 engages with the projecting portion 13*g* in the vicinity of the end portion 13*e* of the outer layer 13 like a gear to constitute a rotation stopping section. This configuration prohibits the outer layer 13 from rotating relative to the rubber layer 12 in the circumferential direction θ (shown in FIG. 6A).

When the conveyed paper sheet 90 is put in pressure contact with the fixing roller 10' during fixing operation with use of the fixing roller 10', the outer layer 13 does not rotate relative to the rubber layer 12 in the circumferential direction since the projecting portion 12*g* of the rubber layer 12 engages with the projecting portion 13*g* of the outer layer 13. As a result, it becomes possible to weaken adhesive strength between the rubber layer 12 and the outer layer 13 by the adhesive. Alternatively, it is possible to eliminate the need of bonding with use of adhesives.

In manufacturing of the fixing roller 10', adhesive can be omitted in Step S3 in the flow of the manufacturing method shown in FIG. 3B (expressed as "NO ADHESIVE/ROTATION STOPPING" in that case).

Thus, in this fixing roller 10', the configuration and manufacturing method of the fixing roller can be simplified and thereby cost reduction can be achieved.

It is to be noted that another rotation stopping section may be provided for stopping the rubber layer 12 from rotating (spinning free) relative to the core metal 11 in the circumferential direction. The rotation stopping section may be constituted of, for example, engagement between a projecting portion of the core metal 11 and a projecting portion of the rubber layer 12, as is the case with the engagement between the projecting portion 12*g* of the rubber layer 12 and the projecting portion 13*g* of the outer layer 13. The rotation stopping section may also be structured as a small hole or a groove extending along an axial direction Y provided on the outer surface 11*a* of the core metal 11, and a part of the rubber layer 12 may be fitted into the small hole or the groove. The rotation stopping section may also be structured as a needlelike projection provided on the outer surface 11*a* of the core metal 11, which may be inserted into the rubber layer 12. In these cases, it becomes possible to eliminate the necessity of bonding the core metal 11 and the rubber layer with adhesives. As a result, configuration and manufacturing method of a fixing roller can be further simplified, and more cost reduction can be achieved thereby.

In each of the above-mentioned embodiments, the fixing member was configured as a cylindrical fixing roller. It should naturally be understood that the present invention is not limited thereto but is preferably applicable to the case where the fixing member is an annular fixing belt.

The pressure roller in the above-mentioned embodiment can also be considered as a fixing member. A heater may be built not only in the fixing roller but also in the pressure roller.

Although the present invention was applied to a tandem type color image forming apparatus in this embodiment, the invention is not limited to this configuration. The photoconductor, the charging means, the exposure means, the developing means, the transfer means, and the fixing means are not limited to have the configuration and layout disclosed in this embodiment but may have other configurations and layouts. The invention is widely applicable to the image forming apparatuses of other types such as rotary configuration type and direct transfer type.

The invention is also applicable to printers, copying machines, facsimiles and multi-functional machines having the functions of these as well as to hard copy systems for data processing/editing and printing.

An object of the invention is to provide a method for manufacturing a fixing member which can suppress generation of ultra fine particles from the rubber layer of the fixing member.

In order to achieve the object, a method for manufacturing a fixing member which is brought into pressure contact with a conveyed sheet to fix an image onto the sheet, according to the present invention, comprises steps of:

forming a rubber layer on an outer surface of a cylindrical or annular base material by injection molding as primary vulcanization;

performing secondary vulcanization of the rubber layer to provide the rubber layer with elasticity; and then providing an outer layer to the outer surface of the rubber layer for aiding release of the sheet.

In the method for manufacturing a fixing member in the invention, secondary vulcanization of the rubber layer is performed before the outer layer is provided on the outer surface of the rubber layer, in other words, in the state where the outer surface of the rubber layer is exposed. Therefore, in the step of the secondary vulcanization, siloxane as ultra fine particles is emitted from the entire region of the outer surface of the rubber layer, which effectively reduces residual siloxane in the entire region of the rubber layer. As a result, in the manufactured fixing member, generation of ultra fine particles from the rubber layer is suppressed. Therefore, it becomes possible to prevent siloxane from causing contamination of the environment inside and around an image forming apparatus.

In the method for manufacturing a fixing member in one embodiment, the secondary vulcanization is performed under conditions of a temperature of 200° C. or higher and a time of 4 hours or longer.

In the method for manufacturing a fixing member in this one embodiment, the secondary vulcanization is performed under conditions of a temperature of 200° C. or higher and a time of 4 hours or longer, so that siloxane as ultra fine particles is easily emitted from the entire region of the outer surface of the rubber layer. Therefore, the residual siloxane in the entire region of the rubber layer is more effectively reduced.

In the method for manufacturing a fixing member in one embodiment, the secondary vulcanization is performed in a state where the base material with the rubber layer formed thereon is housed in a chamber while an inside of the chamber is decompressed with an exhaust device connected to the chamber.

In the method for manufacturing a fixing member in this one embodiment, the secondary vulcanization is performed in a state where the base material with the rubber layer formed thereon is housed in a chamber while an inside of the chamber is decompressed with an exhaust device connected to the chamber. Consequently, siloxane as ultra fine particles is easily emitted from the entire region of the outer surface of the rubber layer. Therefore, the residual siloxane in the entire region of the rubber layer is more effectively reduced.

In the method for manufacturing a fixing member in one embodiment, the secondary vulcanization is performed until number of fine particles in the chamber becomes 2000 or less per cubic centimeter, while the number of fine particles in the chamber is observed with a particle number counter.

In the method for manufacturing a fixing member in this one embodiment, the secondary vulcanization is performed until number of fine particles in the chamber becomes 2000 or less per cubic centimeter, while the number of fine particles in the chamber is observed with a particle number counter. More specifically, conditions (temperature, pressure, time) of the secondary vulcanization are so set that the ultra fine particles emitted from the rubber layer are exhausted and the number of fine particles in the chamber reaches the prescribed value or below. As a consequence, the residual siloxane in the entire region of the rubber layer is more effectively reduced.

Another object of the invention is to provide a fixing member which is manufactured by such a method for manufacturing a fixing member and which can suppress generation of ultra fine particles from the rubber layer.

A fixing member which is brought into pressure contact with a conveyed sheet to fix an image onto the sheet, according to the present invention, comprises:

a cylindrical or annular base material; a rubber layer provided so as to cover an outer surface of the base material and having elasticity; and an outer layer provided so as to cover an outer surface of the rubber layer for aiding release of the sheet, wherein a siloxane content in a central section of the rubber layer is less than twice the siloxane content in an end portion of the rubber layer with respect to a width direction vertical to a circumferential direction on the base material.

In the fixing member of the invention, a siloxane content in a central section of the rubber layer is less than twice the siloxane content in an end portion of the rubber layer with respect to a width direction vertical to a circumferential direction on the base material. Therefore, in this fixing member, it becomes possible to suppress generation of ultra fine particles from the rubber layer as compared with a conventional fixing member (in which the amount of residual siloxane is several times larger in the central section of the rubber layer).

In the fixing member of one embodiment, the siloxane content in the central section of the rubber layer is substantially equal to the siloxane content in the end portion of the rubber layer with respect to the width direction vertical to the circumferential direction on the base material, and wherein a relational expression is satisfied:

$$D<100\times((2\times b)/(b^2-a^2))^{-2.5}\times 2$$

where a represents an internal diameter of the rubber layer in a unit of millimeter, b represents an external diameter of the rubber layer in a unit of millimeter, and D represents the siloxane content in each of the central section and the end portion of the rubber layer in a unit of PPM.

In the fixing member of this one embodiment, the relational expression is satisfied, which can effectively suppress generation of ultra fine particles from the rubber layer.

In the fixing member of one embodiment, the rubber layer and the outer layer are bonded via a fluorochemical adhesive.

In the fixing member of this one embodiment, since the fluorochemical adhesive for bonding the rubber layer and the outer layer is siloxane-free, it becomes possible to desirably prevent the fluorochemical adhesive from becoming an emission source of siloxane.

In the fixing member of one embodiment, a rotation stopping section for stopping the outer layer from rotating relative to the rubber layer in a circumferential direction.

The fixing member of this one embodiment has a rotation stopping section for stopping the outer layer from rotating relative to the rubber layer in a circumferential direction. Even when the conveyed sheet is brought into pressure contact with the fixing member during fixing operation by the fixing member, the rotation stopping section can prohibit the outer layer from rotating relative to the rubber layer in the circumferential direction. As a result, it becomes possible to weaken adhesive strength between the rubber layer and the outer layer by the adhesives. Alternatively, it is possible to eliminate the need of bonding with use of adhesives. Therefore, configuration and manufacturing method of a fixing roller can be simplified, and thereby cost reduction can be achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A fixing member which is brought into pressure contact with a conveyed sheet to fix an image onto the sheet, comprising:

a cylindrical or annular base material; a rubber layer provided so as to cover an outer surface of the base material and having elasticity; and an outer layer provided so as to cover an outer surface of the rubber layer for aiding release of the sheet, wherein the amount of siloxane content present in a central section of the rubber layer is an amount that is less than twice the amount of siloxane content present in an end portion of the rubber layer, the end section and the central section defined as sections along a longitudinal axis extending along an axis of rotation of the fixing member, and the siloxane content in each of the central section and the end portion of the rubber layer is defined by the following expression:

$$D<100\times((2\times b)/(b^2-a^2)^{-2.5}\times 2;$$

wherein "a" represents an internal diameter of the rubber layer in a unit of millimeter, "b" represents an external diameter of the rubber layer in a unit of millimeter, and "D" represents the siloxane content in each of the central section and the end portion of the rubber layer in a unit of PPM.

2. The fixing member as claimed in claim 1, wherein the rubber layer and the outer layer are bonded via a fluorochemical adhesive.

3. The fixing member as claimed in claim 1, comprising:

a rotation stopping section for stopping the outer layer from rotating relative to the rubber layer in a circumferential direction.

4. A fixing device comprising:

a fixing member which is brought into pressure contact with a conveyed sheet to fix an image onto the sheet; and a heating source for heating the fixing member to a target temperature for fixing operation, wherein the fixing member comprises:

a cylindrical or annular base material; a rubber layer provided so as to cover an outer surface of the base material and having elasticity; and an outer layer provided so as to cover an outer surface of the rubber layer for aiding release of the sheet, wherein the amount of siloxane content present in a central section of the rubber layer is an amount that is less than twice the amount of siloxane content present in an end portion of the rubber layer, the end section and the central section defined as sections along a longitudinal axis extending along an axis of rotation of the fixing member, and the siloxane content in each of the central section and the end portion of the rubber layer is defined by the following expression:

$$D<100\times((2\times b)/(b^2-a^2))^{-2.5}\times 2;$$

wherein "a" represents an internal diameter of the rubber layer in a unit of millimeter, "b" represents an external diameter of the rubber layer in a unit of millimeter, and "D" represents the siloxane content in each of the central section and the end portion of the rubber layer in a unit of PPM.

5. The fixing device as claimed in claim 4, wherein the rubber layer and the outer layer are bonded via a fluorochemical adhesive.

6. The fixing device as claimed in claim 4, comprising:

a rotation stopping section for stopping the outer layer from rotating relative to the rubber layer in a circumferential direction.

7. An image forming apparatus comprising the fixing device as claimed in claim 4.

8. The image forming apparatus as claimed in claim 7, wherein the rubber layer and the outer layer are bonded via a fluorochemical adhesive.

9. The image forming apparatus as claimed in claim 7, comprising:

a rotation stopping section for stopping the outer layer from rotating relative to the rubber layer in a circumferential direction.

10. A method for manufacturing a fixing member which is brought into pressure contact with a conveyed sheet to fix an image onto the sheet, comprising steps of:

forming a rubber layer on an outer surface of a cylindrical or annular base material by injection molding as primary vulcanization;

performing secondary vulcanization of the rubber layer to provide the rubber layer with elasticity; and then providing an outer layer to the outer surface of the rubber layer for aiding release of the sheet, wherein the amount of siloxane content present in a central section of the rubber layer is an amount that is less than twice the amount of siloxane content present in an end portion of the rubber layer, the end section and the central section defined as sections along a longitudinal axis extending along an axis of rotation of the fixing member, the siloxane content in the central section of the rubber layer is provided during the forming of the rubber layer, and the secondary vulcanization process is controlled by a controller and a particle number counter such that the secondary vulcanization process is performed until the number of siloxane particles emitted from the rubber layer is reduced to 2000 or less per cubic centimeter.

11. The method for manufacturing a fixing member as claimed in claim 10, wherein the secondary vulcanization is performed under conditions of a temperature of 200° C. or higher and a time of 4 hours or longer.

12. The method for manufacturing a fixing member as claimed in claim 10, wherein the secondary vulcanization is performed in a state where the base material with the rubber layer formed thereon is housed in a chamber while an inside of the chamber is decompressed with an exhaust device connected to the chamber.

* * * * *